US006242573B1

(12) United States Patent
Goto et al.

(10) Patent No.: US 6,242,573 B1
(45) Date of Patent: Jun. 5, 2001

(54) METHOD OF PRODUCING WATER-INSOLUBILIZED REGENERATED COLLAGEN FIBER

(75) Inventors: Masaoki Goto; Shinichi Sakashita; Kunihiko Matsumura, all of Kobe (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 09/431,669

(22) Filed: Nov. 1, 1999

(30) Foreign Application Priority Data

Nov. 2, 1998 (JP) ..... 10-312044
Nov. 6, 1998 (JP) ..... 10-315815
Oct. 25, 1999 (JP) ..... 11-302426

(51) Int. Cl.[7] ..... A61K 38/17; C07K 1/02; C07K 14/78

(52) U.S. Cl. ..... 530/356; 424/402; 424/443; 424/484; 424/486; 424/499; 435/5; 435/7.92; 435/174; 435/180; 435/181; 435/518; 435/535; 514/10; 514/11; 516/99; 530/311; 530/314; 530/317

(58) Field of Search ..... 424/402, 443, 424/484, 486, 499; 435/5, 7.92, 174, 180, 181, 518, 535; 514/10, 11; 516/99; 530/356, 311, 314, 317; 502/426, 451, 455, 507, 586, 575, 48, 50; 604/367, 372, 374, 377; 623/1, 4.1, 5.16, 66

(56) References Cited

FOREIGN PATENT DOCUMENTS 0548946A 6/1993 (EP) .
0 890 663 A2 * 1/1999 (EP) .

OTHER PUBLICATIONS

Sung et al., Studies on Epoxy Compound Fixation, J. Biomed. Materials Res. (Applid Biomaterials), 33:177–186 (1996).*

* cited by examiner

*Primary Examiner*—Christopher S. F. Low
*Assistant Examiner*—Stephen Tu
(74) *Attorney, Agent, or Firm*—Christensen O'Connor Johnson Kindness PLLC

(57) ABSTRACT

A regenerated collagen fiber is subjected to water-insolubilizing treatment with a monofunctional epoxy compound to produce a water-insolubilized regenerated collagen fiber which can substantially maintain the color and the high knot tenacity, inherent in the collagen. Where the monofunctional epoxy compound is an epihalohydrin, a regenerated collagen fiber can be treated with this epihalohydrin and a sulfur compound to produce a water-insolubilized regenerated collagen fiber which can be permanent-wave set. In addition, the water-insolubilized regenerated collagen fiber can be converted into a fiber which can be permanent-wave set, by introducing a disulfide linkage into carboxylic groups of the collagen, which remain unmodified by the insolubilizing treatment.

11 Claims, 1 Drawing Sheet

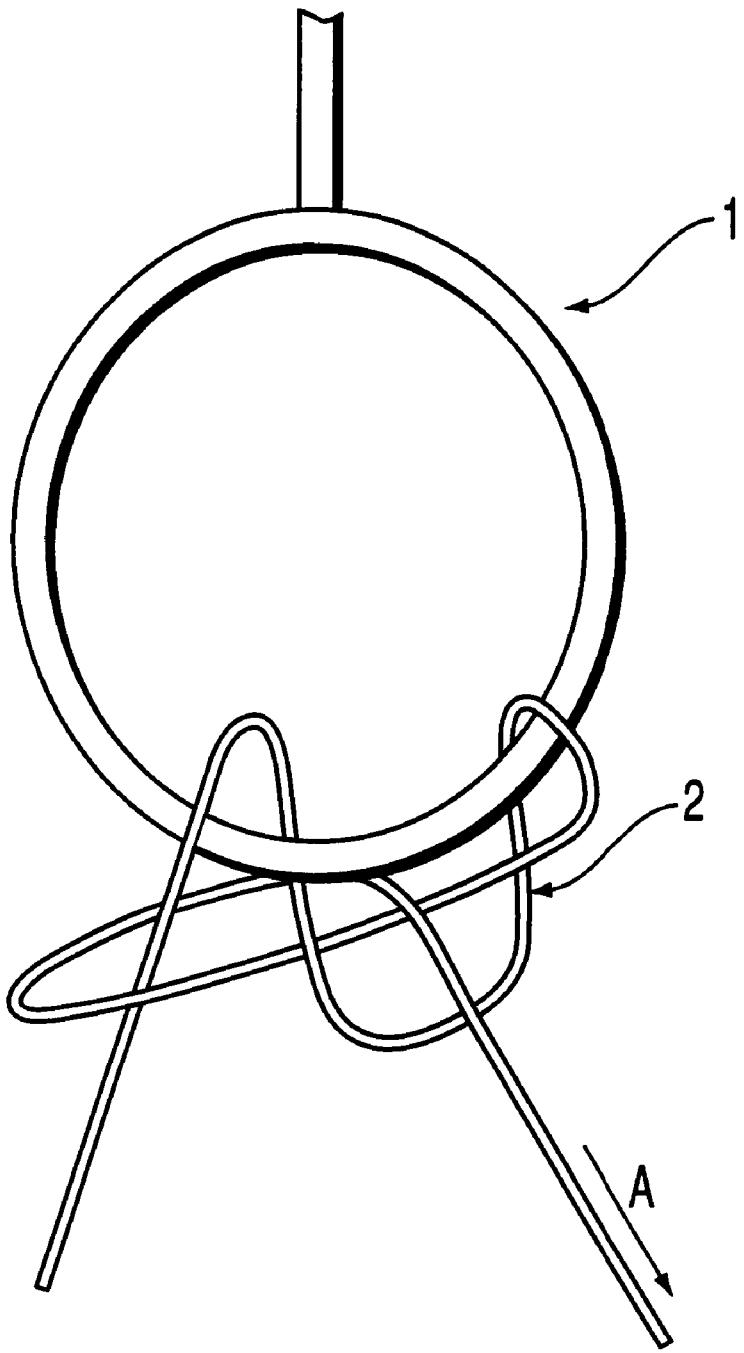
FIGURE

METHOD OF PRODUCING WATER-INSOLUBILIZED REGENERATED COLLAGEN FIBER

BACKGROUND OF THE INVENTION

The present invention relates a method of producing water-insolubilized regenerated collagen fiber, and more particularly, to a method of producing water-insolubilized regenerated collagen fiber, which can substantially maintain the color and the high knot tenacity inherent in the collagen and which also maintains chemically modifiable carboxyl groups of the collagen as it is without being chemically modified.

Among the protein fibers, the regenerated collagen fiber exhibits a high mechanical strength like silk, and, thus, is used in various fields. Particularly, the regenerated collagen fiber is a protein fiber maintaining a characteristic molecular structure derived from collagen and, thus, is close in drape, luster and feel to the human hair that is a natural protein fiber having complex fine structure. Such being the situation, it is attempted to use the regenerated collagen fiber as an animal hair-like fiber such as a fur, or the hair.

In general, the skin or bone of an animal is used as a raw material of the regenerated collagen. The regenerated collagen can be produced by treating these raw materials with an alkali or an enzyme to obtain a water-soluble collagen, followed by extruding and spinning the water-soluble collagen in an aqueous solution of an inorganic salt. Since the regenerated collagen fiber thus obtained is soluble in water, some treatments are applied in order to impart resistance to water to the collagen fiber. As a method for making the regenerated collagen fiber insoluble in water, it is known to the art to treat the water-soluble collagen fiber with an aldehyde compound such as formaldehyde or glutaric aldehyde. It is also known to treat the regenerated collagen fiber with metal salts such as various chromium salts, aluminium salts or zirconium salts to make the regenerated collagen fiber insoluble in water. In the case of using an aldehyde compound other than formaldehyde or a chromium salt, the resultant fiber is colored, resulting in limitation in the use of the treated collagen fiber for manufacturing hairs of various colors such as a white hair or a golden hair. In the case of using formaldehyde, it is certainly possible to obtain a colorless fiber. However, the treated fiber is not satisfactory in beauty.

A colorless treating method of a regenerated collagen fiber using an epoxy compound is proposed in Japanese Patent Disclosure (Kokai) No. 4-352804. In the case of using glycidyl ether of polyhydric alcohol that is described in this prior art as a particularly desirable compound, it is certainly possible to achieve a colorless treatment. However, the knot tenacity is lowered, with the result that a problem tends to be generated during manufacture of the hair decorative article such as the filling step or a sewing step included in the manufacturing process. Also, a colorless treatment can be achieved by some of the methods using the metal salts noted above. However, since the carboxyl groups, the reactive groups, in the collagen are sequestered by the metal salt, the carboxyl groups fail to be chemically modified further. As a result, it is impossible to impart a new function such as a permanent wave to the regenerated collagen fiber after the treatment.

BRIEF SUMMARY OF THE INVENTION

Accordingly, an object of the present invention is to provide a method of producing water-insolubilized regenerated collagen fiber, which can substantially maintain the color and the high knot tenacity inherent in the collagen and which also maintains chemically modifiable carboxyl groups of the collagen substantially intact without being modified.

As a result of an extensive research conducted in an attempt to achieve the above-noted object, the present inventors have found that it is possible to produce a water-insolubilized regenerated collagen fiber that can substantially maintain the color and the high knot tenacity inherent in the collagen by treating the regenerated collagen fiber with a monofunctional epoxy compound (an epoxy compound having only one epoxy group), arriving at the present invention. Particularly, in the case of using epihalohydrin as a monofunctional epoxy compound, it is possible to produce a water-insolubilized regenerated collagen fiber which can achieve permanent wave set by treating the regenerated collagen fiber with this epihalohydrin and a sulfur compound. Incidentally, the permanent wave treatment denotes a treatment to impart a desired shape, which can be maintained, to the hair by an oxidation-reduction reaction using chemicals, in a beauty saloon, at home, etc.

In the treatment of the regenerated collagen fiber with a monofunctional epoxy compound according to the present invention, the carboxyl groups of the collagen are not modified so as to be retained as they are, and thus various characteristics can be imparted to the thus treated regenerated collagen fiber by chemically modifying the carboxylic groups. In this case, a water-insolubilized collagen fiber exhibiting a color substantially equal to the original color of the collagen, that can be permanent-wave set, can be obtained by using a diamine compound having a disulfide linkage as a chemical modifying agent.

Accordingly, the present invention provides a method of producing water-insolubilized regenerated collagen fiber, which comprises treating a regenerated collagen fiber with a water insolubulizing agent comprising a monofunctional epoxy compound.

In a preferred embodiment of the present invention, the monofunctional epoxy compound is represented by formula (I):

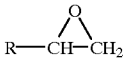

(I)

where R denotes a substituent represented by $R_1$-, $R_2$—$OCH_2$—or $R_2$—COO—$CH_2$—, $R_1$ denotes a hydrocarbon group having at least 2 carbon atoms, or $CH_2Cl$, and each $R_2$ denote a hydrocarbon group having at least 4 atoms.

The present invention also provides a method of producing water-insolubilized regenerated collagen fiber, which comprises treating a regenerated collagen fiber with a water-insolubulizing agent comprising an epihalohydrin, and a sulfur compound.

Further, the present invention provides a method of producing a water-insolubilized regenerated collagen fiber, which comprises subjecting the water-insolubilized collagen fiber obtained by any of the methods noted above to an amidation reaction, in the presence of a condensing agent, with at least one diamine compound selected from the group consisting of a diamine having a disulfide linkage represented by formula (II):

$$H_2N(CH_2)_nSS(CH_2)_nNH_2 \quad \text{(II)}$$

where n denotes an integer of 1 to 4, or its salt, and a diamine having a disulfide linkage represented by formula (III):

$$H_2NCH(OOR_1)CH_2SSCH_2CH(OOR_2)NH_2 \quad (III)$$

where each of $R_1$ and $R_2$ independently represents an alkyl group having 1 to 4 carbon atoms or benzyl group.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawing, which are incorporated in and constitute a part of the specification, illustrate presently preferred embodiments of the invention, and together with the general description given above and the detailed description of the preferred embodiments given below, serve to explain the principles of the invention.

The accompanying drawing schematically shows the knot of a thread and a pulling portion for measuring the knot tenacity.

DETAILED DESCRIPTION OF THE INVENTION

In the present invention, it is desirable to use split leather as a raw material of the regenerated collagen fiber, though it is possible to use the skin or bone of an animal that is generally used as a raw material of the regenerated collagen fiber. Split leather can obtained from a fresh raw hide or a salted hide of animals such as cows. A slight flesh portion is attached to form a network to split leather peeled from the raw hide. Where the raw hide is salted, the salt remains in the split leather. Therefore, the remaining flesh portion or salt is removed before split leather is put to a practical use. Also, split leather under this condition, which mainly consists of an insoluble collagen, still contains impurities, for example, lipids such as glyceride, phospholipid and free fatty acids, and proteins other than collagen, such as sugar proteins and albumin. Since these impurities greatly affect adversely the spinning stability in forming fiber, the quality such as luster and elongation of the resultant fiber, and the odor, it is desirable to remove these impurities in advance by, for example, dipping split leather in lime to hydrolyze the fat components so as to loosen the collagen, followed by applying a conventional hide treatment such as an acid-alkali treatment, an enzyme treatment and a solvent treatment.

Then, a solubilizing treatment is applied in order to cut the peptide portion crosslinking the insoluble collagen. It is possible to employ the alkali solubilizing method or an enzyme solubilizing method, which are widely known to the art and widely employed in general, as a method of the solubilizing treatment.

In the case of employing the alkali solubilizing method, it is desirable to neutralize the solubilized (regenerated) collagen with an acid such as hydrochloric acid. It is possible to employ the method disclosed in, for example, Japanese Patent Publication (Kokoku) No. 46-15033 as an improved alkali solubilizing method.

The enzyme solubilizing method is advantageous in that it is possible to obtain a regenerated collagen having a uniform molecular weight and, thus, the enzyme solubilizing method can be effectively employed in the present invention. The method disclosed in, for example, Japanese Patent Publication (Kokoku) No. 43-25829 or Japanese Patent Publication (Kokoku) No. 43-27513 can be employed in the present invention as a suitable enzyme solubilizing method. Incidentally, it is possible to employ in combination both the alkali solubilizing method and the enzyme solubilizing method in the present invention.

Where additional treatments such as pH adjustment, salting-out, water wash and treatment with a solvent are applied to the collagen to which the solubilizing treatment has been applied, it is possible to obtain a regenerated collagen fiber having an excellent quality. Thus, it is desirable to apply these additional treatments to the solubilized collagen.

The solubilized collagen thus obtained is dissolved in an acidic aqueous solution having the pH value adjusted at 2 to 4.5 with hydrochloric acid, acetic acid, lactic acid, etc. to provide a stock solution of a predetermined concentration of, for example, 1 to 15% by weight, particularly 2 to 10% by weight. Incidentally, it is possible to apply as desired a defoaming treatment by stirring under a reduced pressure to the resultant collagen aqueous solution and to apply filtering for removing fine dust that is insoluble in water.

It is also possible to mix as desired additives such as a stabilizer and a water-soluble high molecular weight compound to the aqueous solution of the solubilized collagen in order to improve, for example, the mechanical strength, the resistance to water and to heat, luster and the spinning properties and to prevent coloring and decomposition.

Thereafter, the aqueous solution of the solubilized collagen is discharged through, for example, a spinning nozzle or slit, and the discharged solution is dipped in a coagulation bath comprising an aqueous solution of an inorganic salt so as to obtain a regenerated collagen fiber. An aqueous solution of an inorganic salt such as sodium sulfate, sodium chloride, or ammonium sulfate can be used as the aqueous solution of the inorganic salt. In general, the inorganic salt concentration of the aqueous solution is set at 10 to 40% by weight.

It is desirable to set the pH value of the aqueous solution of the inorganic salt at, generally, 2 to 13, preferably 4 to 12 by adding a metal salt such as sodium borate or sodium acetate or hydrochloric acid, acetic acid or sodium hydroxide to the aqueous solution. Where the pH value is smaller than 2 or exceeds 13, the peptide linkage of collagen is likely to be hydrolyzed, sometimes resulting in failure to obtain a desired fiber. Also, it is desirable for the temperature of the aqueous solution of the inorganic salt, which is not particularly limited in the present invention, to be set in general, for example, at most 35° C. Where the temperature of the aqueous solution is higher than 35° C., the soluble collagen is denatured or the mechanical strength of the spun fiber is lowered, with the result that it is difficult to manufacture fiber thread with a high stability. The lower limit of the temperature range is not particularly limited in the present invention. It suffices to set the lower limit of the temperature appropriately in accordance with the solubility of the inorganic salt. However, the temperature is generally at least 15° C.

It is possible to treat, as desired, the regenerated collagen fiber with a treating agent such as an aqueous solution containing a high concentration of a salt or with an organic solvent such as a water-soluble alcohol or an aqueous solution thereof, or to preserve the regenerated collagen in such a treating agent. It is also possible to apply a pretreatment such as drying to the regenerated collagen fiber after the treatment or preservation. Further, after the drying, the regenerated collagen fiber may be treated with or preserved in a treatment agent such as another organic solvent or an aqueous solution of the organic solvent.

In the present invention, the regenerated collagen fiber which can be obtained as described above is treated with a water-insolubilizing agent comprising a monofunctional epoxy compound to produce a water-insolubilized regenerated collagen fiber. The monofunctional epoxy compound used in the present invention includes, for example, olefin oxides such as ethylene oxide, propylene oxide, butylene oxide, isobutylene oxide, octene oxide, styrene oxide, methylstyrene oxide, epihalohydrin (e.g., epichlorohydrin, epibromohydrin), and glycidol; glycidyl ethers such as glycidyl methyl ether, butyl glycidyl ether, octyl glycidyl ether, nonyl glycidyl ether, undecyl glycidyl ether, tridecyl glycidyl ether, pentadecyl glycidyl ether, 2-ethylhexyl glycidyl ether, allyl glycidyl ether, phenyl glycidyl ether, cresyl glycidyl ether, t-butyl phenyl glycidyl ether, dibromophenyl glycidyl ether, benzyl glycidyl ether, and polyethylene oxide glycidyl ether; glycidyl esters such as glycidyl formate, glycidyl acetate, glycidyl acrylate, glycidyl methacrylate and glycidyl benzoate; and glycidyl amides. The monofunctional epoxy compound used in the present invention is not limited to those exemplified above.

It is desirable to use, among the monofunctional epoxy compounds noted above, monofunctional epoxy compounds represented by formula (I):

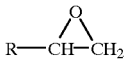

(I)

where R denotes a substituent represented by $R_1$-, $R_2$—$OCH_2$— or $R_2$—COO—$CH_2$—, $R_1$ denotes a hydrocarbon group having at least 2 carbon atoms, or $CH_2Cl$, and each $R_2$ denote a hydrocarbon group having at least 4 carbon atoms. The hydrocarbon group represented by $R_1$ usually has at most 50 carbon atoms, and the hydrocarbon group represented by $R_2$ usually has at most 50 carbon atoms.

In the case of treating the regenerated collagen fiber with the monofunctional epoxy compound represented by formula (I), the water absorption rate of the regenerated collagen fiber is lowered so as to improve the feel when wet. Further, it is particularly desirable to use those epoxy compounds of formula (I) in which R represents a hydrocarbon group having 2 to 6 carbon atoms or $CH_2Cl$, and those epoxy compounds of formula (I) in which R represents $R_2$—$OCH_2$— or $R_2$—COO—$CH_2$—and $R_2$ denotes a hydrocarbon group having 4 to 6 carbon atoms. In this case, the reactivity is high so as to permit the treatment in a short time, and also the treatment in water can be carried out relatively easily.

The monofunctional epoxy compound should be desirably used in an amount of 0.1 to 500 equivalents, preferably 0.5 to 100 equivalents, and more preferably 1 to 50 equivalents, per equivalent of the amino group contained in the regenerated collagen fiber. Where the amount of the monofunctional epoxy compound is less than 0.1 equivalent, the insolubilizing effect is insufficient. On the other hand, where the amount of the monofunctional epoxy compound exceeds 500 equivalents, it is often difficult to handle industrially the regenerated collagen fiber and the fiber tends to give rise to an environmental problem, though the regenerated collagen fiber is made sufficiently insoluble in water.

The monofunctional epoxy compound can be used as it is or may be dissolved in a suitable solvent. Such a solvent includes, for example, water; alcohols such as methanol, ethanol, and isopropanol; ethers such as tetrahydrofuran and dioxane; halogen-containing organic solvents such as dichloromethane, chloroform and carbon tetrachloride; and neutral organic solvents such as DMF and DMSO. These solvents can be used singly or in combination. Where water is used as the solvent, it is possible to use as required an aqueous solution of an inorganic salt such as sodium sulfate, sodium chloride or ammonium sulfate. In general, the concentration of the inorganic salt is adjusted at 10 to 40% by weight. It is also possible to adjust the pH value of the aqueous solution by using a metal salt such as sodium borate or sodium acetate as well as another compound such as hydrochloric acid, boric acid, acetic acid or sodium hydroxide. In this case, the pH value should desirably be controlled at 6 to 13, preferably at 8 to 12. Where the pH value is less than 6, the reaction between the epoxy group of the monofunctional epoxy compound and the amino group of collagen is retarded. As a result, the regenerated collagen fails to be made sufficiently insoluble in water. A similar situation is brought about where the pH value exceeds 13. In addition, the peptide linkage of collagen tends to be hydrolyzed, resulting in failure to obtain a desired fiber. Since the pH value tends to be lowered with time, it is possible to use a buffering agent, as required.

The regenerated collagen fiber can be treated by immersion in the monofunctional epoxy compound or a solution thereof. The temperature of the treatment is preferably at most 50° C. Where the treating temperature exceeds 50° C., the regenerated collagen fiber may be denatured. As a result, the treated fiber fails to exhibit a sufficiently high mechanical strength, making it difficult to manufacture thread with a high stability. Usually, the treating temperature is at least 15° C.

It is possible to use various additives such as a catalyst and a reaction aid. For example, the catalyst includes amines and imidazoles. More specifically, the amines include, for example, tertiary amines such as triethyl diamine, tetramethyl guanidine, triethanol amine, N,N'-dimethyl piperazine, benzyl dimethyl amine, dimethyl aminomethyl phenol, 2,4,6-tris(dimethyl aminomethyl) phenol; secondary amines such as piperazine and morpholine; and quaternary ammonium salts such as tetramethyl ammonium salt, tetraethyl ammonium salt, and benzyl triethyl ammonium salt. The imidazoles include, for example, 2-methylimidazole, 2-ethylimidazole, 2-isopropyl-imidazole, 1-cyanoethyl-2-methylimidazole, 1-cyanoethyl-2-ethylimidazole, 1-cyanoethyl-2-isopropylimidazole and 2-ethyl-4-methylimidazole. On the other hand, the reaction aid includes, for example, salicylic acid or a metal salt of salicylic acid; thiocyanates such as thiocyanic acid and ammonium thiocyanate; tetramethyl thiuram disulfide; and thiourea. It is preferred that the catalyst is used in an amount of 1/100to 1 equivalent per equivalent of the epoxy compound, while the reaction aid may be used in an amount of 1/20to 1 equivalent per equivalent of the epoxy compound.

The monofunctional epoxy compound preferentially reacts with the amino group in the regenerated collagen fiber rather than the carboxylic groups of the collagen fiber, to form the amide linkage, and does not substantially modify the carboxylic groups of the collagen fiber to allow the carboxylic groups remain substantially intact.

Where the water-insolubilizing agent comprises epihalohydrin, among the monofunctional epoxy compounds noted above, it is possible to produce a water-insolubilized regenerated collagen fiber which can be effectively undergone a permanent wave treatment by treating the regenerated collagen fiber with this epihalohydrin and a sulfur compound. The epihalohydrin is preferably epichlorohydrin. Epichlorohydrin is also called chloromethyloxirane or 1-chloro-2,3-epoxypropane, and these terms refer to the same compound.

In the treatment of the regenerated collagen fiber with epihalohydrin and a sulfur compound, it is believed that epihalohydrin reacts with both the amino group of the collagen molecule and the sulfur compound so as to permit a mercapto group to be introduced, sometimes via the formation of a Bunte salt (salt having —$SSO_3$—), into the regenerated collagen fiber. In short, this treatment makes it possible to introduce a mercapto group into the amino group of the regenerated collagen fiber, with the epihalohydrin bonded to the amino group of the regenerated collagen fiber at its one end and bonded to the mercapto group at its other end, so as to form a collagen fiber exhibiting a color substantially equal to the original color of the collagen, that can be permanent-wave set. This treatment can be carried out by immersing the regenerated collagen fiber in the epihalohydrin or a solution thereof as noted above, and then in the sulfur compound or a solution thereof, or by immersing the regenerated collagen fiber in a treating agent containing both the epihalohydrin and the sulfur compound. It is also envisaged to carry out a reaction first between the epihalohydrin and the sulfur compound, followed by immersing the regenerated collagen fiber in the reaction solution. The immersion treatment in the sulfur compound is preferably carried out at a temperature of at most 50° C. for at least 5 minutes. Also, the immersion treatment in the reaction solution obtained by reacting the epihalohydrin and the sulfur compound is preferably carried out at a temperature of at most 50° C. for at least 5 minutes. Usually, these immersion treatments are carried out at a temperature of at least 0° C.

The sulfur compound used in the present invention includes, for example, hydrosulfides such as sodium hydrosulfide, potassium hydrosulfide and ammonium hydrosulfide; thiosulfates such as sodium thiosulfate, and potassium thiosulfate; amines having a mercapto group such as cysteamine and cysteine; and amines having a disulfide linkage such as cystamine, cystine, cystine methyl ester, cystine ethyl ester, cystine propyl ester, cystine butyl ester, and cystine benzyl ester. Particularly, thiosulfate is preferred in the present invention. Further, the compounds represented by formula (II) or (III), which will be described later, may be used as the sulfur compounds.

Such a sulfur compound may be used in an amount of at least 1/500equivalents, preferably 0.5 to 2 equivalents, per equivalent of the epihalohydrin.

Further, in the present invention, water wash, oiling and drying are applied as required to the regenerated collagen fiber. The drying is effective for strengthening the fiber structure so as to improve the feel, water absorption, nerve, etc. The drying should be carried out at a temperature of at most 100° C., preferably at most 80° C. If the drying temperature exceeds 100° C., collagen tends to be denatured, resulting in failure to obtain a desired effect sufficiently.

The water wash is intended to prevent precipitation of an oiling agent caused by a salt and to prevent the salt from being precipitated from the regenerated collagen fiber during drying within a drying machine. If the salt is precipitated, the regenerated collagen fiber is cut or broken. Also, the formed salt scatters within the drying machine so as to be attached to the heat exchanger within the drying machine, leading to a low heat transfer coefficient. In other words, the washing with water is intended to overcome these problems. On the other hand, the oiling is effective for preventing the fiber from hanging up in the drying step and for improving the surface state of the regenerated collagen fiber.

The regenerated collagen fiber thus obtained exhibits a color substantially equal to the original color of the collagen and is excellent in the knot tenacity. In addition, since the carboxyl groups remain substantially unmodified, it is possible to introduce various chemical modifications and metal crosslinking into the thus insolubilized regenerated collagen fiber so as to impart various properties to the regenerated collagen fiber and to dye the regenerated collagen fiber relatively easily. Further, the water-insolubilized regenerated collagen fiber of the present invention exhibits a drape, luster and feel equivalent to those of the natural protein fiber and, thus, can be used effectively as substitutes for the human hair, hide and, particularly, for the golden and variously colored human hair.

The present invention provides a method of introducing a disulfide linkage into the carboxyl group of the water-insolubilized regenerated collagen fiber as one of techniques for the chemical modifications.

The modification of the carboxyl groups can be performed by the amidation reaction, in the presence of a condensing agent, between the water-insolubilized regenerated collagen fiber and at least one diamine selected from the group consisting of a diamine having a disulfide linkage represented by formula (II) below or a salt thereof, and a diamine having a disulfide linkage represented by formula (III):

$$H_2N(CH_2)_nSS(CH_2)_nNH_2 \quad \text{(II)}$$

where n denotes an integer of 1 to 4;

$$H_2NCH(OOR_1)CH_2SSCH_2CH(OOR_2)NH_2 \quad \text{(III)}$$

where each of $R_1$ and $R_2$ independently represents an alkyl group having 1 to 4 carbon atoms or benzyl group. The reaction of the diamine compound with the carboxylic group of the collagen requires the presence of a condensing agent.

Specific examples of the diamine compounds represented by formula (II) include, for example, cystamine, cystamine dihydrochloride, and cystamine sulfate. On the other hand, the diamine compounds represented by formula (III) include, for example, D-cystine methyl ester, L-cystine methyl ester, D,L-cystine methyl ester mixture, D-cystine ethyl ester, L-cystine ethyl ester, D,L-cystine ethyl ester mixture, D-cystine propyl ester, L-cystine propyl ester, D,L-cystine propyl ester mixture, D-cystine butyl ester, L-cystine butyl ester, D,L-cystine butyl ester mixture, D-cystine benzyl ester, L-cystine benzyl ester and D,L-cystine benzyl ester mixture.

The amidation reaction can be carried out by dipping the water-insolubilized regenerated collagen fiber in a reaction solvent having the diamine compound represented by formula (II) or (III) and a condensing agent dissolved therein. In the amidation reaction, it is desirable to use the diamine in an amount of at least 0.05 equivalent, preferably at least 0.5 equivalent, more preferably at least 1 equivalent, per equivalent of the carboxylic group of the regenerated collagen fiber. Further, it is desirable to use the condensing agent in an amount of at least 0.05 equivalent, preferably at least 0.5 equivalent, more preferably at least 1 equivalent, per equivalent of the carboxylic group of the regenerated collagen fiber. Moreover, it is desirable that the concentration of the diamine compound represented by formula (II) or (III) and the condensing agent is at least 10 mM, the treating temperature is at most 50° C., and the dipping time is at least 5 minutes. Usually, the treating temperature is at least 0° C. Where water is used as a solvent, pH value should desirably be 7.0 to 3.0.

The condensing agent used in the present invention includes, for example, carbodiimides such as 1-ethyl-3-(3'-dimethylaminopropyl)carbodiimide and its hydrochloride, 1-benzyl-3 -(3'-dimethylaminopropyl)carbodiimide and its hydrochloride, 1-cyclohexyl-3 -(2-morpholynoethyl) carbodiimide meso-p-toluene sulfonate, N,N'-diisopropylcarbodiimide, N,N'-dicyclohexylcarbodiimide; benzotriazoles such as 1H-benzotriazol-1-yl-oxytripyrrolidinophosphonium hexafluorophosphate, benzotriazol-1-yl-oxytris(dimethyl amino)phosphonium hexafluorophosphonate, O-(benzotriazol-1-yl)-N,N,N',N'-tetramethyluronium hexafluoroborate; N,N'-carbonyldiimidazole, 2-ethoxy-1-ethoxycarbonyl-1,2-dihydroquinone, and diphenyl phosphoryl azide. These condensing agents can be used singly or in the form of a mixture of some of these condensing agents. In order to accelerate the reaction and to suppress the side reaction, it is desirable to use the condensing agent in combination with, for example, N-hydroxysuccinimide, 1-hydroxybenzotriazole, or 3 -hydroxy-4-oxo-3,4-dihydro-1,2,3-benzotriazine.

The solvent used for the amidation reaction includes, for example, water; alcohols such as methyl alcohol, ethyl alcohol, isopropanol; ethers such as tetrahydrofuran and dioxane; halogen-containing organic solvents such as dichloromethane, chloroform, and carbon tetrachloride; and neutral organic solvents such as DMF and DMSO. These solvents can be used singly or in combination.

The water-insolubilized regenerated collagen fiber treated with the monofunctional epoxy compound having a disulfide linkage can be deformed as desired by the oxidation-reduction reaction, and the deformation can be retained. In addition, the regenerated collagen fiber thus treated is little colored, retains a drape, luster and feel of the natural protein fiber and, thus, can be used effectively as a fiber raw material exhibiting a color substantially equal to the original color of the collagen, that can be imparted with a permanent wave set and, thus, can be used effectively for providing substitutes for the human hair, the animal hair and, particularly, golden hair and various colored hairs and for achieving improvements thereof. Particularly, where epihalohydrin is used as the monofunctional epoxy compound, and the regenerated collagen fiber is treated with this epihalohydrin and the sulfur compound, followed by introducing a disulfide linkage into the carboxyl group, a permanent wave can be set more strongly. It follows that the regenerated collagen fiber thus treated can be used more effectively for the fields described above.

Incidentally, the amount of the amino groups and carboxylic groups in the regenerated collagen fiber can be determined, as well known in the art, by hydrolyzing the regenerated collagen fiber, analyzing the amino acid composition of the hydrolyzed coliagen, and calculating the amounts of the amino groups and carboxylic groups based on the analysis. More specifically, for example, about 1 mg of the regenerated collagen fiber is weighed accurately, to which 0.1 mL of 6N hydrochloric acid is added, and the resultant mixture is heated at 110° C. for 22 hours to hydrolyze the collagen, and is dried. The dried matter is diluted appropriately, and its amino acid composition is analyzed by a special amino acid analysis/ninhydrin color reaction method using, for example, amino acid analyzer type 835 available from Hitachi Limited.

The present invention will be described in detail by way of its Examples that follow. However, the present invention should not be limited by these Examples. In all the examples below, the preparation of a regenerated collagen fiber and an oil treatment were conducted as follows:

(A) Preparation of Regenerated Collagen Fiber

Split leather of a cattle, which was used as a raw material, was made soluble by the treatment with an alkali, followed by dissolving the thus obtained collagen in an aqueous solution of lactic acid. Then, a stock solution having the pH value adjusted at 3.5 and having the collagen concentration adjusted at 6% by weight was subjected to a defoaming treatment by stirring under a reduced pressure, followed by transferring the treated solution to a piston type spinning stock solution tank. The solution thus transferred was further allowed to stand under a reduced pressure for the defoaming purpose. Then, the stock solution was extruded by a piston, followed by transferring a predetermined amount of the extruded solution by a gear pump and subsequently filtering the extruded solution through a sintered filter. Further, the filtered extrudate was passed through a spinning nozzle having 50 pores each pore having a pore diameter of 0.35 mm, and a pore length of 0.5 mm so as to discharge the filtered extrudate into a coagulating bath at 25° C. containing 20% by weight of sodium sulfate and having the pH value adjusted at 11 with boric acid and sodium hydroxide. The filtered extrudate was discharged into the coagulating bath at a spinning rate of 4 m/minutes.

(B) Oil Treatment

A water-insolubilized regenerated collagen fiber was dipped in a bath containing an oily agent consisting of an emulsion of an amino-modified silicone and PLURONIC polyether antistatic agent so as to allow the oily agent to adhere to the fiber.

EXAMPLES 1–13

A regenerated collagen fiber was obtained by the method described in item (A) above.

Then, the monofunctional epoxy compound shown in Table 1 was put, in an amount of 42.6 equivalents per equivalent of the amino group contained in the collagen, in an aqueous solution containing 0.9% by weight of 2,4,6-tris-(dimethylaminomethyl)phenol, 0.09% by weight of salicylic acid, and 13% by weight of sodium sulfate, followed by dipping the regenerated collagen fiber obtained as above in the solution at 25° C. for 24 hours.

After washing the resultant water-insolubilized regenerated collagen fiber with a flowing water for one hour, an oil treatment was performed by the method described in item (B), followed by drying the fiber under tension by using a soaking drying machine set at 75° C.

EXAMPLES 14–16

A regenerated collagen fiber was obtained by the method described in item (A) above.

Then, the monofunctional epoxy compound shown in Table 1 was put, in an amount of 10.7 equivalents per equivalent of the amino group contained in the collagen, in an aqueous solution containing 0.09% by weight of 2,4,6-tris(dimethylaminomethyl)phenol, 0.009% by weight of salicylic acid, and 13% by weight of sodium sulfate, followed by dipping the regenerated collagen fiber obtained as above in the solution at 25° C. for 24 hours.

After washing the resultant water-insolubilized regenerated collagen fiber with a flowing water for one hour, an oil treatment was performed by the method described in item (B), followed by drying the fiber under tension by using a soaking drying machine set at 75° C.

EXAMPLE 17

A regenerated collagen fiber was obtained by the method described in item (A) above.

Then, the resultant fiber was washed with an acetone-water solvent mixed at 1:1 and, then, with acetone. On the other hand, cresyl glycidyl ether was put, in an amount of 10.7 equivalents per equivalent of the amino group contained in the collagen, in an acetone solution containing 0.13% by weight of 2,4,6-tris-(dimethylaminomethyl) phenol and 0.013% by weight of salicylic acid, followed by dipping the regenerated collagen fiber in the solution at 25° C. for 24 hours.

After washing the resultant water-insolubilized regenerated collagen fiber with acetone and with a flowing water for one hour, an oil treatment was performed by the method described in item (B), followed by drying the fiber under tension by using a soaking drying machine set at 75° C.

Comparative Example 1

A regenerated collagen fiber was obtained by the method described in item (A) above.

EX-512 (trade name: DENACOL, which is polyglycerol polyglycidyl ether having an epoxy equivalent of 168 and manufactured by Nagase Chemical Industries K.K.) was put, in an amount of 10.7 equivalents per equivalent of the amino group contained in the collagen, in an aqueous solution containing 0.9% by weight of 2,4,6-tris-(dimethylaminomethyl)phenol, 0.09% by weight of salicylic acid and 13% by weight of sodium sulfate, followed by dipping the regenerated collagen fiber obtained as above in the solution at 25° C. for 24 hours.

After washing the resultant water-insolubilized regenerated collagen fiber with a flowing water for one hour, an oil treatment was performed by the method described in item (B), followed by drying the fiber under tension by using a soaking drying machine set at 75° C.

The properties of the water-insolubilized regenerated collagen fibers prepared in Examples 1–17 and Comparative Example 1 were examined as follows:

<Fineness>

The fineness (d) was measured under an atmosphere at a temperature of 20±2° C. and a relative humidity of 65±2% by using Denier Computer DC-77A (trade name of an autovibration type fineness measuring meter manufactured by Search K.K., and was converted into decitex (dtex) unit. In this conversion, the fractions of 0.5 and over are counted as a unit and the rest was cut away.

<Knot Tenacity>

A monofilament 2 put under an atmosphere at a temperature of 20±2° C. and a relative humidity of 65±2% (hereinafter referred to as standard condition) was knotted as shown in FIG. 1 about a ring 1 mounted to a hand-held digital force gauge DFG-2K type manufactured by Shimpo K.K. (not shown) and the monofilament 2 was pulled at A at a rate of about 50 cm/sec so as to measure the force (g) at break. The measured value (g) was converted into centinewton (cN) unit. In this conversion, the fractions of 0.5 and over are counted as a unit and the rest was cut away.

<Water Absorption Rate>

The fiber was dipped in a distilled water at a temperature of 27±1° C. for 20 minutes, and the water absorption rate was determined by the equation:

Water absorption rate (%)={(Ww−Wd)/Wd}×100 where Ww denotes the weight (g) of the fiber after removal of the water attached to the surface of the fiber, and Wd denotes the constant weight (g) after the fiber was dried at 150° C. in a soaking drying machine.

Table 1 shows the results of Examples 1–17 and Comparative Example 1.

TABLE 1

| Examples | Epoxy Compound | Fineness (dtex) | Knot Tenacity (cN) | Color | Water Absorption Rate (%) |
|---|---|---|---|---|---|
| 1 | Propylene oxide | 61 | 51 | White | 179 |
| 2 | Glycidol | 61 | 44 | White | 237 |
| 3 | Glycidyl methyl ether | 62 | 33 | White | 164 |
| 4 | Lauryl alcohol $(EO)_{15}$ glycidyl ether | 58 | 25 | Light yellow | 227 |
| 5 | Phenol $(EO)_5$ glycidyl ether | 69 | 23 | Light yellow | 163 |
| 6 | Glycidyl methacrylate | 59 | 70 | White | 186 |
| 7 | Epichlorohydrin | 63 | 41 | White | 77 |
| 8 | Butylene oxide | 70 | 40 | Yellow | 138 |
| 9 | Isobutylene oxide | 77 | 37 | Yellow | 107 |
| 10 | Styrene oxide | 83 | 29 | Yellow | 68 |
| 11 | Butyl glycidyl ether | 80 | 28 | White | 98 |
| 12 | Phenyl glycidyl ether | 80 | 39 | White | 77 |
| 13 | Allyl glycidyl ether | 76 | 37 | Yellow | 133 |
| 14 | Epichlorohydrin | 62 | 47 | White | 104 |
| 15 | Phenyl glycidyl ether | 69 | 39 | White | 96 |
| 16 | Cresyl glycidyl ether | 57 | 63 | White | 224 |
| 17 | Cresyl glycidyl ether | 67 | 42 | White | 91 |
| Comp. Ex. 1 | Polyglycerol polyglycidyl ether | 64 | 11 | White | 110 |

(In Table 1, (EO) at Examples 4 and 5 denotes ethylene oxide, and the annex thereto indicates the polymerization degree.)
Note:
Fineness: 1 dtex (decitex) = 0.9 d (denier);
Knot tenacity: 1 cN (centinewton) = 1.0197 g (gram)

As apparent from Table 1, the fiber treated with a monofunctional epoxy compound is little colored, and is superior in the knot tenacity to the fiber treated with a polyfunctional epoxy compound.

EXAMPLE 18

A regenerated collagen fiber was obtained by the method described in item (A) above.

The regenerated collagen fiber thus obtained was dipped in an aqueous solution, at 30° C. for 24 hours, which contained 1.7% by weight of epichlorohydrin (17 mmol per gram of collagen), 0.09% by weight of 2,4,6-tris-(dimethylaminomethyl)phenol, 0.009% by weight of salicylic acid, and 13% by weight of sodium sulfate.

After washing the resultant water-insolubilized regenerated collagen fiber with a flowing water for one hour, the fiber was further dipped in an aqueous solution containing 8% by weight of sodium thiosulfate (22.6 mmol per gram of collagen) at 30° C. for 24 hours.

After washing the resultant collagen fiber with a flowing water for one hour, an oil treatment was performed by the method described in item (B), followed by drying the fiber under tension at 75° C. by using a soaking drying machine.

EXAMPLE 19

A regenerated collagen fiber was obtained by the method described in item (A) above.

The regenerated collagen fiber thus obtained was dipped in an aqueous solution, at 30° C. for 24 hours, which contained 1.7% by weight of epichlorohydrin (17 mmol per gram of collagen), 0.09% by weight of 2,4,6-tris-(dimethylaminomethyl)phenol, 0.009% by weight of salicylic acid, and 13% by weight of sodium sulfate.

After washing the resultant water-insolubilized regenerated collagen fiber with a flowing water for one hour, the fiber was further dipped in an aqueous solution containing 6.5% by weight of sodium hydrosulfide (36.4 mmol per gram of collagen) at 30° C. for 24 hours.

After washing the resultant collagen fiber with a flowing water for one hour, an oil treatment was performed by the method described in item (B), followed by drying the fiber under tension at 75° C. by using a soaking drying machine.

EXAMPLE 20

A regenerated collagen fiber was obtained by the method described in item (A) above.

An aqueous solution containing 1.6% by weight of epichlorohydrin (17 mmol per gram of collagen), 2.8% by weight of sodium thiosulfate (17.0 mmol per gram of collagen), and 13% by weight of sodium sulfate was kept stirred at 30° C. for 30 minutes. Added to the resultant aqueous solution were 0.09% by weight of 2,4,6-tris (dimethylaminomethyl)phenol and 0.009% by weigh of salicylic acid, in which the regenerated collagen fiber prepared as above was dipped at 30° C. for 24 hours.

After washing the resultant water-insolubilized regenerated collagen fiber with a flowing water for one hour, an oil treatment was performed by the method described in item (B), followed by drying under tension the fiber at 75° C. by using a soaking drying machine.

EXAMPLE 21

The fiber obtained in Example 1 was kept dipped at 25° C. for 24 hours in a methanol solution containing 1.6% by weight of cystamine dihydrochloride and 2.9% by weight of N,N'-dicyclohexylcarbodiimide. Then, the fiber was washed with methanol and water, followed by drying the fiber under tension at 75° C. by using a soaking drying machine.

EXAMPLE 22

The fiber obtained in Example 2 was kept dipped at 25° C. for 24 hours in a methanol solution containing 1.6% by weight of cystamine dihydrochloride and 2.9% by weight of N,N'-dicyclohexylcarbodiimide. Then, the fiber was washed with methanol and water, followed by drying the fiber under tension at 75° C. by using a soaking drying machine.

EXAMPLE 23

The fiber obtained in Example 3 was kept dipped at 25° C. for 24 hours in a methanol solution containing 1.6% by weight of cystamine dihydrochloride and 2.9% by weight of N,N'-dicyclohexylcarbodiimide. Then, the fiber was washed with methanol and water, followed by drying the fiber under tension at 75° C. by using a soaking drying machine.

Comparative Example 2

A regenerated collagen fiber was obtained by the method described in item (A) above.

The regenerated collagen fiber thus obtained was kept dipped in an aqueous solution (adjusted to pH 9 with boric acid and sodium hydroxide), at 25° C. for 30 minutes, which contained 1.0% by weight of formaldehyde and 15% by weight of sodium sulfate. An oil treatment was performed by the method described in item (B), followed by subjecting the regenerated collagen fiber to a soaking treatment under tension at 75° C. by using a soaking drying machine.

Comparative Example 3

A regenerated collagen fiber was obtained by the method described in item (A) above.

The regenerated collagen fiber thus obtained was kept dipped in an aqueous solution, at 30° C. for 24 hours, which contained 9.0% by weight of DENACOL EX-512 (trade name of polyglycerol polyglycidyl ether manufactured by Nagase Chemical Industries, Ltd.), 0.9% by weight of 2,4,6-tris-(dimethylaminomethyl)phenol, 0.09% by weight of salicylic acid and 13% by weight of sodium sulfate.

After washing the resultant water-insolubilized regenerated collagen fiber with a flowing water for 1 hour, an oil treatment was performed by the method described in item (B), followed by subjecting the regenerated collagen fiber to a soaking treatment under tension at 75° C. by using a soaking drying machine.

The properties of the regenerated collagen fibers obtained in Examples 18–23 and Comparative Examples 2–3 were measured as follows.

<Sulfur Content>

The fiber was subjected to a complete combustion by using a sample combusting apparatus QF-02 manufactured by Mitsubishi Chemical Co., Ltd., and the combustion gas was absorbed by a 0.3% hydrogen peroxide water. Then, the sulfate ion concentration of the absorbed water was measured by an ion chromatography IC-7000 Series II manufactured by Yokogawa K.K. so as to determine the sulfur content. The sulfur content in the SH group or the SS linkage was calculated as follows:

$$A=B-C$$

where, A represents the sulfur content of the SH group or SS linkage, B represents the measured value of the fiber to which SH groups or SS linkages were imparted, and C represents the measured value of the fiber to which either SH group or SS linkage was not imparted.

The measured value of the fiber to which SH group or SS linkage was not imparted represents the methionine residue.

<Permanent Wave Treatment Test>

The effect produced by the permanent wave treatment was tested as follows.

Specifically, 300 to 350 fibers were bundled and cut to align the length of the bundle at 20 cm. The bundled fibers were wound about a No. 5 rod and kept dipped at 40° C. for 15 minutes in a first liquid for a permanent wave treatment, which was prepared by preparing an aqueous solution containing 6.5% of thioglycolic acid monoethanolamine, followed by adjusting the pH value at 2.9 to 9.6 with monoethanolamine. Then, the bundled fibers were dipped in a second liquid, i.e., 5% aqueous solution of sodium bromate, at 40° C. for 15 minutes. The fibers were released from the rod and washed with water in a free state so as to observe and organoleptically evaluate the waving. Further, after the water attached to the surface of the fibers was removed, the length of the fiber in a hung state was measured. Where a shape that can be retained was imparted by the permanent wave treatment, the fiber was made shorter than 20 cm, and where such a shape was not imparted, the fiber was 20 cm long.

<Criteria for Evaluation>

The permanent wave treatment was evaluated by observation within water and by the fiber length when the fiber was hung. The criteria for evaluations were as shown in Tables 2 and 3 below.

TABLE 2

| Observation within Water | |
|---|---|
| Evaluation by Observation within Water | Judgment |
| ◎ | Excellent wave |
| ○ | Somewhat good wave |
| Δ | Ordinary |
| × | Wave shape not imparted |

Method of Evaluation: Organoleptically evaluated

TABLE 3

| Fiber Length under Hung State | |
|---|---|
| Fiber Length under Hung State | Judgment |
| At most 17 cm | Excellent (pass) |
| More than 17 cm, but at most 18 cm | Good (pass) |
| More than 18 cm, but at most 19 cm | Ordinary (pass) |
| More than 19 cm, but at most 20 cm | Not pass |

Method of Evaluation: Measured length immediately after hanging

Table 4 shows the results of the test on the human hair in respect of Examples 18 to 23 and Comparative Examples 2 and 3.

TABLE 4

| Sample | Color | Fineness (dtex) | Knot Tenacity (cN) | Water Absorption Rate (%) | Sulfur Content (% by weight) of SH Group and SS Linkage | Permanent Wave Effect: Observation within Water | Permanent Wave Effect: Hanging Length (cm) |
|---|---|---|---|---|---|---|---|
| Example 18 | White | 58 | 29 | 81 | 1.0 | ○ | 17.5 |
| Example 19 | White | 61 | 52 | 131 | 0.7 | Δ | 18.0 |
| Example 20 | White | 59 | 28 | 120 | 1.6 | ○ | 17.0 |
| Example 21 | White | 62 | 21 | 80 | 3.2 | ◎ | 13.5 |
| Example 22 | White | 67 | 29 | 108 | 3.1 | ◎ | 14.0 |
| Example 23 | White | 64 | 20 | 88 | 3.5 | ◎ | 13.5 |
| Comp. Ex. 2 | White | 56 | 25 | 120 | 0.0 | X | 20.0 |
| Comp. Ex. 3 | White | 64 | 11 | 110 | 0.0 | X | 20.0 |
| Human Hair | — | — | — | — | — | ◎ | 14.0 |

Note:
Fineness: 1 dtex (decitex) = 0.9 d (denier);
Knot tenacity: 1 cN (centinewton) = 1.0197 g (gram)

From the results shown in Table 4, it is clearly seen that the regenerated collagen fiber treated with epichlorohydrin and a sulfur compound permits the permanent wave treatment to produce waving. It is also seen that, by also employing a treatment to introduce a disulfide linkage to the carboxyl group, the permanent wave treatment permits imparting a stronger waving to the regenerated collagen fiber.

EXAMPLES 24 to 40

The fibers obtained in each of Examples 1 to 17 was dipped at 25° C. for 24 hours in methanol containing 1.6% by weight of cystamine dihydrochloride and 2.9% of N,N'-dicyclohexylcarbodiimide. Then, the fiber was washed with methanol and water, followed by drying the fiber at 75° C. by using a soaking drying machine.

Comparative Example 4

The fiber obtained in Comparative Example 1 was dipped at 25° C. for 24 hours in methanol containing 1.6% by weight of cystamine dihydrochloride and 2.9% of N,N'-dicyclohexylcarbodiimide. Then, the fiber was washed with methanol and water, followed by drying the fiber at 75° C. by using a soaking drying machine.

Table 5 shows the results of Examples 24 to 40 and Comparative Example 4.

TABLE 5

| Examples | Permanent Wave Effect Hanging Length (cm) | Fineness (dtex) | Knot Tenacity (cN) | Color | Water Absorption Rate (%) |
|---|---|---|---|---|---|
| 24 | 13.5 | 63 | 43 | White | 101 |
| 25 | 15.5 | 62 | 37 | White | 114 |
| 26 | 15.0 | 66 | 25 | White | 101 |
| 27 | 15.0 | 59 | 18 | Light yellow | 119 |
| 28 | 14.0 | 71 | 17 | Light yellow | 91 |
| 29 | 14.5 | 66 | 27 | White | 102 |
| 30 | 16.0 | 67 | 30 | White | 78 |
| 31 | 14.0 | 71 | 32 | Yellow | 98 |
| 32 | 13.0 | 76 | 22 | Yellow | 85 |
| 33 | 13.0 | 78 | 29 | Light yellow | 77 |
| 34 | 12.5 | 76 | 24 | White | 69 |
| 35 | 12.0 | 77 | 27 | White | 66 |
| 36 | 13.5 | 70 | 18 | Yellow | 80 |
| 37 | 15.5 | 66 | 34 | White | 95 |
| 38 | 12.0 | 69 | 31 | White | 68 |
| 39 | 13.5 | 59 | 32 | Light yellow | 91 |
| 40 | 13.0 | 69 | 28 | White | 65 |
| Comp. Ex. 4 | 15.5 | 67 | 4 | White | 88 |

Note:
Fineness: 1 dtex (decitex) = 0.9 d (denier);
Knot tenacity: 1 cN (centinewton) = 1.0197 g (gram)

From the results shown in Table 5, it is seen that where the regenerated collagen fiber is treated with a monofunctional epoxy compound, and a disulfide linkage is introduced to the carboxylic groups of the resultant collagen fiber, a fiber exhibiting a color substantially equal to the original color of the collagen can be obtained, which is excellent in knot tenacity, and can be permanent-wave set.

As described above, the regenerated collagen fiber made insoluble in water by treatment with a monofunctional epoxy compound according to the present invention can substantially maintain the color and the high knot tenacity, inherent in collagen. It follows that the regenerated collagen fiber treated by the method of the present invention can be used as a satisfactory substitute for the human hair, animal hair, string, and particularly for the golden human hair and a light-colored animal hair. What should also be noted is that, if the carboxyl group of collagen is chemically modified to introduce therein a disulfide linkage, a water-insolubilized collagen fiber exhibiting a color substantially equal to the original color of the collagen can be obtained, which can be permanent-wave set and exhibits an improved water absorption.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of producing a water-insolubilized regenerated collagen fiber which has been obtained by spinning a regenerated and solubilized collagen into fiber, and treating the regenerated collagen fiber with an insolubilizing agent to lower its water absorption rate, the insolubilizing agent comprising a monofunctional epoxy compound of the formula (I):

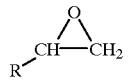

where R denotes a substituent represented by $R_1$—, $R_2$—$OCH_2$—, $R_2COO$—$CH_2$—, $R_1$ denotes a hydrocarbon group having at least two carbon atoms, or $CH_2Cl$ and each $R_2$ denotes a hydrocarbon group having at least four carbon atoms.

2. The method according to claim 1, wherein $R_1$ is a hydrocarbon group having 2 to 6 carbon atoms or $CH_2Cl$, and $R_2$ is a hydrocarbon group having 4 to 6 carbon atoms.

3. A method of producing a water-insolubilized regenerated collagen fiber, comprising treating a regenerated collagen fiber with a water-insolubilizing agent to lower its water absorption rate, the insolubilizing agent comprising an epihalohydrin and a sulfur compound.

4. A method of producing water-insolubilized regenerated collagen fiber, comprising treating a regenerated collagen fiber with an insolubilizing agent comprising a monofunctional epoxy compound to produce a water-insolubilized regenerated collagen fiber, subjecting said water-insolubilized regenerated collagen fiber to an amidation reaction in the presence of the condensing agent, with at least one diamine compound selected from the group consisting of a diamine having a disulfide linkage represented by formula (II): $H_2N(CH_2)_nSS(CH_2)_nNH_2$ where n denotes an integer of 1 to 4, or its salt, and a diamine having a disulfide linkage represented by formula (III): $H_2NCH(OOR_1)CH_2SSCH_2CH(OOR_2)NH_2$ where each $R_1$ and $R_2$ independently represents alkyl group having 1 to 4 carbon atoms or benzyl group.

5. A method of producing water-insolubilized regenerated collagen fiber, comprising subjecting a water-insolubilized regenerated collagen fiber obtained by the method defined in claim 4 to an amidation reaction, in the presence of a condensing agent, with at least one diamine compound selected from the group consisting of a diamine having a disulfide linkage represented by formula (II):

$$H_2N(CH_2)_nSS(CH_2)_nNH_2 \quad \text{(II)}$$

where n denotes an integer of 1 to 4, or its salt, and a diamine having a disulfide linkage represented by formula (III):

$$H_2NCH(OOR_1)CH_2SSCH_2CH(OOR_2)NH_2 \quad \text{(III)}$$

where each of $R_1$ and $R_2$ independently represents an alkyl group having 1 to 4 carbon atoms or benzyl group.

6. A water-insolubilized collagen fiber, wherein said collagen fiber has been obtained by spinning a regenerated and solubilized collagen into fiber, and treating the regenerated collagen fiber with an insolubilizing agent to lower its water absorption rate, the insolubilizing agent comprising a monofunctional epoxy compound of the formula (I):

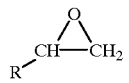

where R denotes a substituent represented by $R_1$—, $R_2$—$OCH_2$—, $R_2COO$—$CH_2$—, $R_1$ denotes a hydrocarbon group having at least two carbon atoms, or $CH_2Cl$ and each $R_2$ denotes a hydrocarbon group having at least four carbon atoms.

7. A water-insolubilized collagen fiber, wherein said collagen fiber has been obtained by the method according to claim 6.

8. A water-solubilized collagen fiber, wherein said collagen fiber has been obtained by spinning a regenerated and solubilized collagen into fiber, and treating the regenerated collagen fiber with an insolubilizing agent to lower its water absorption rate, the insolubilizing agent comprising a monofunctional epoxy compound of the formula (I):

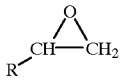

where R denotes a substituent represented by $R_1$—, $R_2$—$OCH_2$—, $R_2COO$—$CH_2$—, $R_1$ denotes a hydrocarbon group having at least 2 to 6 carbon atoms, or $CH_2Cl$ and each $R_2$ denotes a hydrocarbon group having at least 4 to 6 carbon atoms.

9. A water-solubilized collagen fiber, wherein said collagen fiber has been obtained by treating a regenerated collagen fiber with a water-insolubilizing agent to lower its water absortion rate, the insolubilizing agent comprising an epihalohydrin and a sulfur compound.

10. A water insolubilized collagen fiber, wherein said collegen fiber has been obtained by treatng a regenerated collagen fiber with an insolubilizing agent comprising a monofunctional epoxy compound to produce a water-insolubilized regenerated collagen fiber, subjecting said water-insolubilized regenerated collagen fiber to an amidation reaction in the presence of a condensing agent, with at least one diamine compound selected from the group consisting of a diamine having a disulfide linkage represented by formula (II):

$$H_2N(CH_2)_nSS(CH_2)_nNH_2 \quad \text{(II)}$$

where n denotes an integer of 1 to 4, or its salt and a diamine having a disulfide linkage represented by formula (III)

$$H_2NCH(OOR_1)CH_2SSCH_2CH(OOR_2)NH_2 \quad \text{(III)}$$

where each of $R_1$ and $R_2$ independently represents an alkyl group having 1 to 4 carbon atoms or benzyl group.

11. A water insolubilized collagen fiber, wherein said collegen fiber has been obtained by treatng a subjecting a water-insolubilized regenerated collagen fiber obtained by treating a regeneratedcollagen fiber with water-insolubilzing agent comprising an epihalohydrin and a sulfur compound to an amidation reaction, in the presence of a condensing agent, with at least one diamine compound selected from the group consisting of a diamine having a disulfide linkage represented by formula (II):

$$H_2N(CH_2)_nSS(CH_2)_nNH_2 \quad \text{(II)}$$

where n denotes an integer of 1 to 4, or its salt and a diamine having a disulfide linkage represented by formula (III)

$$H_2NCH(OOR_1)CH_2SSCH_2CH(OOR_2)NH_2 \quad \text{(III)}$$

where each of $R_1$ and $R_2$ independently represents an alkyl group having 1 to 4 carbon atoms or benzyl group.

* * * * *

UNITED STATES PATENT AND TRADEMARK OFFICE

CERTIFICATE OF CORRECTION

PATENT NO. : 6,242,573 B1
DATED : June 5, 2001
INVENTOR(S) : M. Goto et al.

It is certified that error appears in the above-identified patent and that said Letters Patent is hereby corrected as shown below:

Title page,
Item [56], References Cited, OTHER PUBLICATIONS, "Applid" should read -- (Applied --

Column 18,
Line 40, "claim 4, should read -- claim 3 --

Column 19,
Line 18, after "having" delete "at least"
Line 26, "treatng" should read -- treating --

Column 20,
Line 3, "salt" should read -- salt, --
Line 4, "(III)" should read -- (III): --
Line 12, "water insolubilized" should read -- water-insolublilized --
Line 13, after "by" delete "treating a"
Line 15, "regeneratedcollagen" should read -- regenerated collagen --
Line 24, "its salt and" should read -- its salt, and --
Line 25, "(III)" should read -- (III): --

Signed and Sealed this

Eighteenth Day of June, 2002

*Attest:*

*Attesting Officer*

JAMES E. ROGAN
*Director of the United States Patent and Trademark Office*